US007966924B1

(12) United States Patent
Peters et al.

(10) Patent No.: US 7,966,924 B1
(45) Date of Patent: Jun. 28, 2011

(54) NON-LINEAR FEEDBACK IN A DUAL YOKE HYDROMODULE

(75) Inventors: Russell Peters, Ames, IA (US); Jamie Welker, Altoona, IA (US)

(73) Assignee: Sauer-Danfoss Inc., Ames, IA (US)

( * ) Notice: Subject to any disclaimer, the term of this patent is extended or adjusted under 35 U.S.C. 154(b) by 440 days.

(21) Appl. No.: 12/208,435

(22) Filed: Sep. 11, 2008

(51) Int. Cl.
*F15B 15/00* (2006.01)
*F04B 9/00* (2006.01)

(52) U.S. Cl. ..... 91/506; 92/12.2

(58) Field of Classification Search ..... 91/499, 91/506; 92/12.2, 57, 71
See application file for complete search history.

(56) References Cited

U.S. PATENT DOCUMENTS

| | | | | |
|---|---|---|---|---|
| 3,722,372 | A | 3/1973 | Freese | |
| 3,958,496 | A | 5/1976 | Wallin | |
| 4,739,618 | A | 4/1988 | Kita et al. | |
| 4,757,743 | A | 7/1988 | Tovey | |
| 5,135,031 | A | 8/1992 | Burgess et al. | |
| 5,335,495 | A | 8/1994 | Sato et al. | |
| 6,109,033 | A | 8/2000 | Folsom et al. | |
| 6,260,468 | B1 * | 7/2001 | Ryken et al. | 91/506 |
| 6,358,174 | B1 | 3/2002 | Folsom et al. | |
| 6,422,254 | B1 | 7/2002 | Ryken | |
| 6,773,368 | B1 | 8/2004 | Williames | |
| 6,887,045 | B2 | 5/2005 | Schaeffer | |
| 6,996,980 | B2 | 2/2006 | Fleming et al. | |
| 7,159,395 | B2 | 1/2007 | Fleming et al. | |
| 2005/0070391 | A1 | 3/2005 | Folsom et al. | |
| 2005/0086919 | A1 | 4/2005 | Stiefvater et al. | |
| 2007/0249454 | A1 | 10/2007 | Williames | |

FOREIGN PATENT DOCUMENTS

| | | |
|---|---|---|
| EP | 0234132 | 2/1987 |

* cited by examiner

*Primary Examiner* — Thomas E Lazo

(57) ABSTRACT

A variable displacement bent axis unit comprising a housing and a yoke pivotally disposed therein wherein the yoke has a cam member attached thereto. A control mechanism that changes the displacement of the unit has a control valve disposed therein that engages the cam member. The cam member itself has a non-linear feedback profile such that the feedback profile provides a linearized speed ratio.

6 Claims, 2 Drawing Sheets

NON-LINEAR FEEDBACK IN A DUAL YOKE HYDROMODULE

BACKGROUND OF THE INVENTION

This invention relates to a bent axis type hydraulic unit. More particularly, this invention relates to a swinging yoke type bent axis hydraulic unit.

Bent axis hydraulic units have been known for many years. One of these types is considered a "swinging yoke" configuration such as disclosed by Ryken et al. in U.S. Pat. No. 6,257,119. In this configuration a cylinder block kit is carried by a yoke and swings with it to vary displacement of the unit.

In bent axis hydraulic units wherein dual rotating kits are provided (also known as dual yoke hydromodules) there is a fixed link between the two kits of the dual yoke hydromodule. This fixed ratio results in a very high and non-linear speed ratio gain as the dual yoke is stroked. Specifically, in a hydrostatic transmission application with a variable pumping unit and a variable motoring unit the speed ratio between the two units is determined by the ratio of the displacements of both rotating kits. As the displacement of either unit is changed the speed ratio either increases or decreases. This ratio for the majority of the range of displacement is linear and relatively fixed. As the displacement of the pumping unit or motoring unit approaches zero displacement the speed ratio becomes non-linear and exponential. The exponential nature of the speed ratio and speed ratio gain are undesired.

Therefore, a principal object of the present invention is to provide a dual yoke hydromodule that minimizes the exponential nature of the speed ratio.

Yet another object of the present invention is to counteract the rate of speed ratio gain in a bent axis hydraulic unit.

These and other objects, features, or advantages of the present invention will become apparent from the specification and claims.

BRIEF SUMMARY OF THE INVENTION

A variable displacement bent axis unit having a housing with a yoke pivotally mounted therein about the trunnions of the yoke. The yoke has a cam member attached thereto. First and second elongated actuator rods each have generally opposite first and second ends, the second including a servo piston thereon and the first end of each actuator rod is drivingly connected to the yoke to pivot the yoke about the trunnions. Additionally provided is a control mechanism for changing the displacement of the unit and including a control housing having spaced apart servo bores for receiving the servo pistons on the second ends of the actuator rods, a control valve is disposed within the control mechanism and engages the cam member. The cam member has a non-linear feedback profile to provide a non-linear cam feedback that results in a linearized speed ratio.

DETAILED DESCRIPTION OF THE PREFERRED EMBODIMENT

Figure 1:
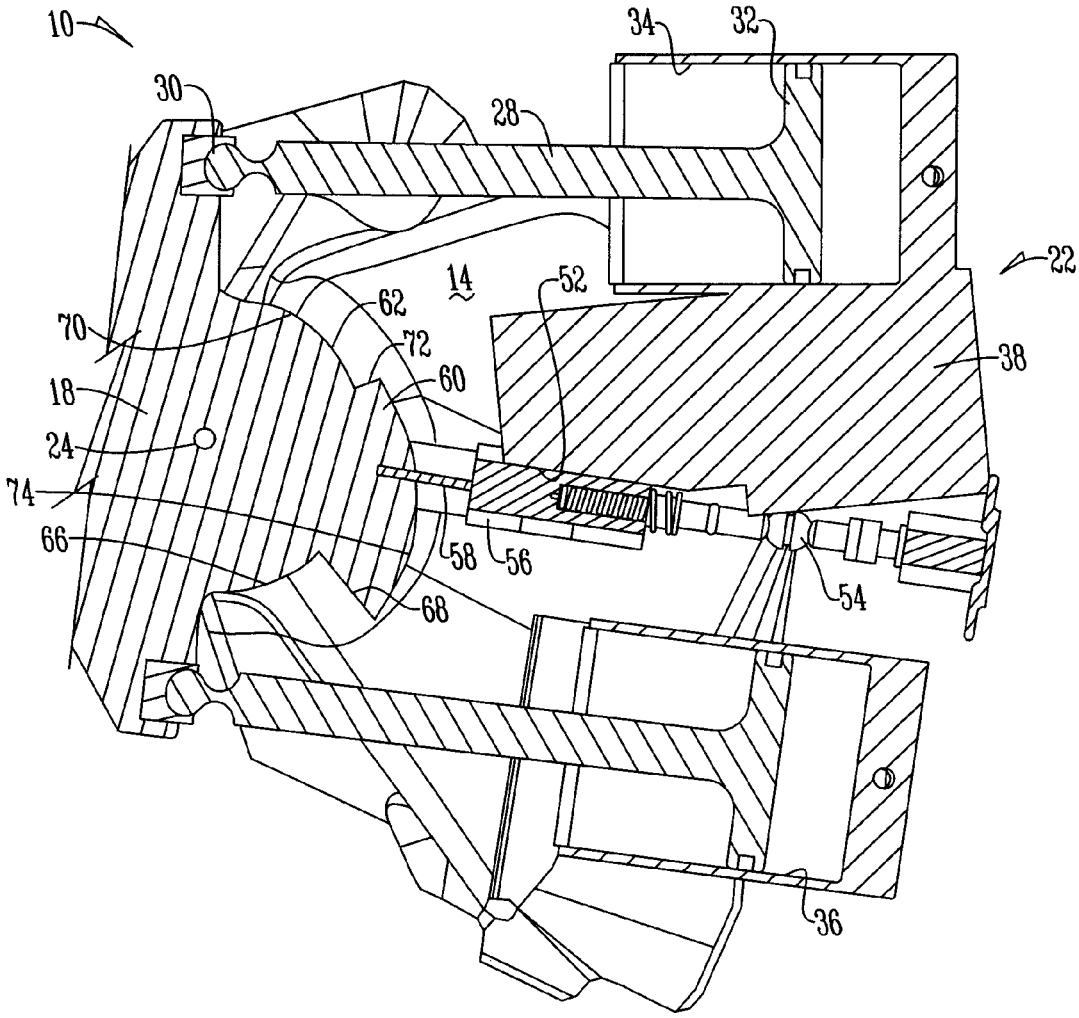
FIG. 1 is a sectional view of a variable displacement bent axis unit.

FIG. 1 depicts a bent axis variable displacement hydraulic unit 10. The displacement of the bent axis unit 10 is varied by a swinging yoke 14 which carries conventional cylinder blocks or cylinder block kits drivingly connected to a main shaft that is rotatably supported in a housing. The yoke 14 is forced to swing or pivot about a pair of opposing pivot arms or trunnions 18 by control 22. Preferably the trunnions 18 share a common fixed pivot axis or axis of rotation 24.

Elongated actuator rods 28 have substantially spherical and preferably external surface 30 on a first end and a servo piston 32 on the second end. The servo pistons 32 are slidably, sealingly, and tiltably received respectively in servo bores 34 and 36 of a control housing 38. Although many arrangements are possible, each of the servo bores 34, 36 preferably has a central axes which is skewed with respect to the other servo bore. The bores 34, 36 need not be parallel to each other. As a result, the central axes of the servo bores 34, 36 can form a variety of angles with respect to the trunnion 18.

The control 22 also includes a control bore that receives a linearly actuated hydraulic displacement control 52 which has the necessary conventional and appropriate porting to port oil to the servo bores 34, 36 respectively. The displacement control 52 has a spool 54 linked to a feedback cam follower mechanism 58. The cam follower mechanism 58 is mounted in a sleeve 56 and slides back and forth as it engages the integral cam member 60 formed on the yoke 14.

Cam member 60 has a non-linear feedback profile 62 disposed about a cam axis 24. The profile has a first arcuate section 66 that extends about the cam axis 24 and terminates in a first radial section 68. The profile 62 additionally has a second arcuate section 70 that extends about the cam axis 24 and terminates in a second radial section 72. The first and second radial sections 68 and 72 extend away from the cam axis 24. Connecting the first radial section 68 with the second radial section 72 is a third arcuate section 74 that is engaged by the feedback mechanism 58. Arcuate section 74 embodies the non-linear cam feedback profile.

Figure 2:
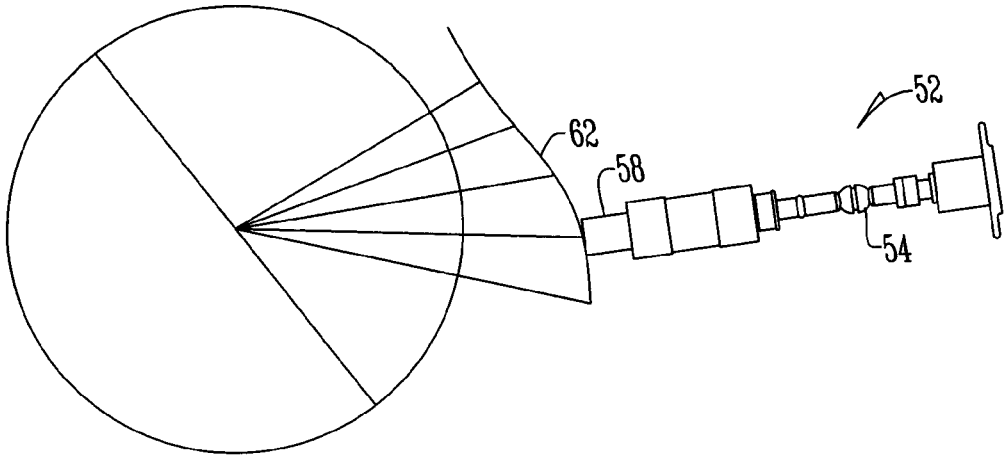
FIG. 2 is a side schematic diagram of a non-linear feedback cam surface and control.

The non-linear feedback profile 74 counteracts both the exponential nature of the speed ratio and the max speed ratio issues. This is accomplished by making the feedback mechanism 58 of the control 22 non-linear proportional to the non-linearity of the speed ratio itself. FIG. 2 illustrates the 2D geometry of the non-linear feedback mechanism. Thus, as a result of the non-linear feedback profile, non-linear cam feedback for a dual yoke hydromodule is provided. The non-linear feedback profile can be customized to change speed ratio gain to an optimum value and to linearize the speed ratio. Consequently, all of the stated objectives have been met.

It will be appreciated by those skilled in the art that other various modifications could be made to the device without departing from the spirit and scope of this invention. All such modifications and changes fall within the scope of the claims and are intended to be covered thereby.

What is claimed is:

1. A variable displacement bent axis unit comprising:

a housing;

a yoke pivotally mounted in the housing about trunnions and having a cam member attached thereto;

first and second elongated actuator rods each having generally opposite first and second ends, the second end including a servo piston thereon, the first end of each actuator rod drivingly connected to the yoke to pivot the yoke about the trunnions;

a control mechanism for changing the displacement of the unit and including a control housing having spaced apart servo bores for receiving the servo pistons on the second ends of the actuator rods and a control valve disposed therein that engages the cam member; and wherein the cam member has a non-linear feedback profile.

2. The unit of claim 1 wherein the non-linear feedback profile provides a linearized speed ratio.

3. The unit of claim 1 wherein the non-linear feedback profile provides a non-linear cam feedback.

4. The unit of claim 1 wherein the non-linear feedback profile comprises:

a first radial section that extends away from the cam axis;

a second radial section that extends away from the cam axis; and a third arcuate section extending between the first and second radial sections.

5. The unit of claim 4 wherein the first radial section extends further away from the cam axis than the second radial section.

6. The unit of claim 4 wherein the second radial section extends further away from the cam axis than the first radial section.

* * * * *